US006398661B1

(12) United States Patent
Llewellyn

(10) Patent No.: US 6,398,661 B1
(45) Date of Patent: Jun. 4, 2002

(54) PUTTING BOX

(76) Inventor: Larry Llewellyn, 130 W. 25th St., Hamilton, Ontario (CA), L9C 4X5

( * ) Notice: Subject to any disclaimer, the term of this patent is extended or adjusted under 35 U.S.C. 154(b) by 0 days.

(21) Appl. No.: 09/568,849

(22) Filed: May 11, 2000

Related U.S. Application Data

(60) Provisional application No. 60/137,818, filed on May 28, 1999.

(51) Int. Cl.[7] ..... A63B 69/36

(52) U.S. Cl. ..... 473/180

(58) Field of Search ..... 473/153, 174, 473/180, 181, 185, 186, 184, 190, 191, 194, 195

(56) References Cited

U.S. PATENT DOCUMENTS

| | | | | | |
|---|---|---|---|---|---|
| 2,475,763 | A | * | 7/1949 | Vandal | 473/186 |
| 2,938,729 | A | * | 5/1960 | Billfaldt | 473/180 |
| 3,114,556 | A | * | 12/1963 | Miller | 473/185 |
| 3,494,620 | A | * | 2/1970 | Schmudde et al. | 473/180 |
| 3,700,243 | A | * | 10/1972 | Kenney | 473/180 |
| 3,817,535 | A | * | 6/1974 | Doughty | 473/185 |
| 3,909,006 | A | * | 9/1975 | Arbaugh | 473/172 |
| 4,667,964 | A | | 5/1987 | Hickey | 273/176 E |
| 5,205,559 | A | | 4/1993 | Plopper | 273/177 R |
| 5,645,492 | A | | 7/1997 | Anderson | 473/185 |
| 6,179,722 | B1 | * | 1/2001 | Bond | 473/180 |

* cited by examiner

*Primary Examiner*—Mark S. Graham

(57) ABSTRACT

A Putting Box comprising a frame defining a putting target and a ball storage area for housing numerous balls therein, said frame having a bottom plane for placement onto flat surfaces. The putting box further including a ball aperture defined within a side of said frame adapted to allow golf balls to pass there through, said ball aperture providing an entry way for balls to rollably enter into said ball storage area of said frame when said frame is placed onto a flat surface. The putting box further including and a ball diverter including a rolling surface lying substantially parallel and along a bottom plane, and adapted to rollably receive balls rolling through said entry way and rollably diverting and maintaining balls away from said entry way. Preferably the rolling surface includes a convex surface which directs balls away from said entry way.

17 Claims, 8 Drawing Sheets

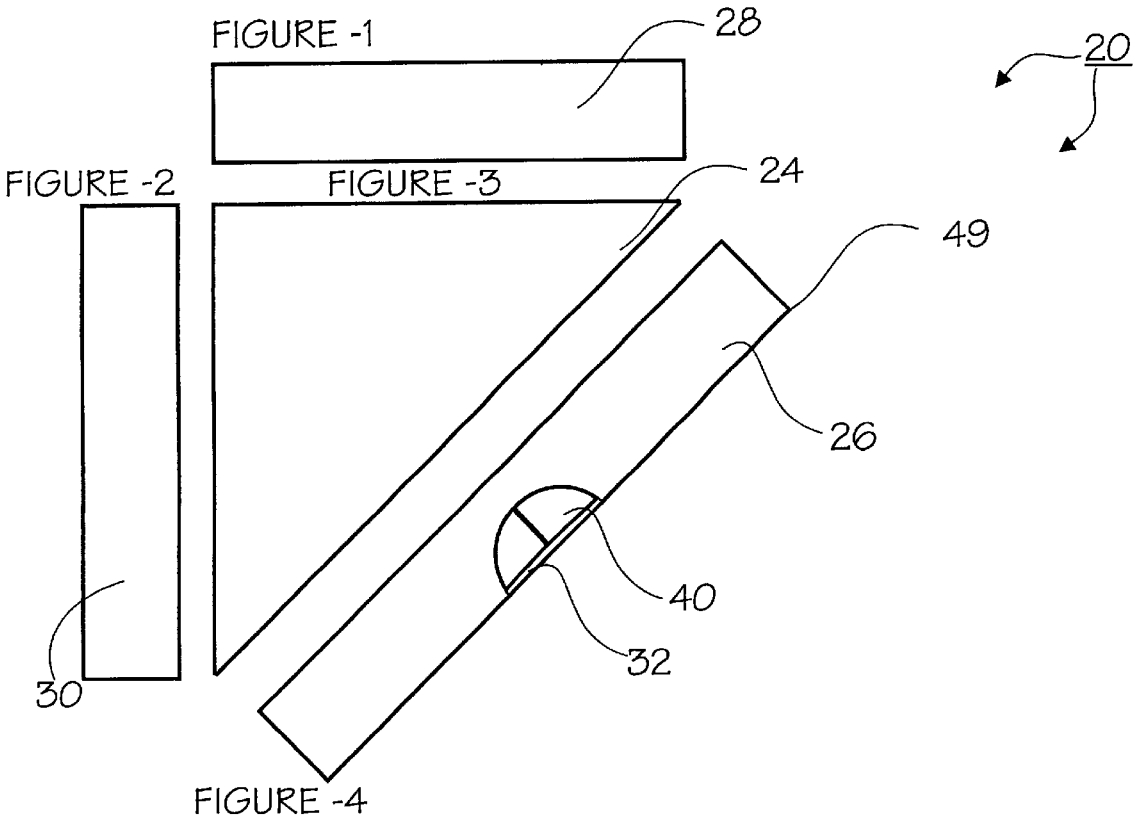
FIGURE -1
28
20
FIGURE -2
FIGURE -3
24
49
26
40
32
30
FIGURE -4
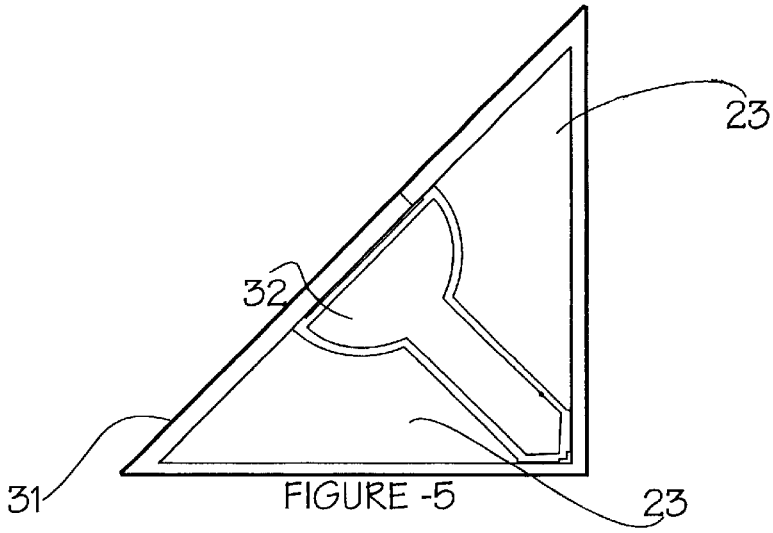
23
32
31
FIGURE -5
23

66

50
58
58
64
58
54
52
56
52
62
58
66
52
66
32
54
50

52
60
66
60
66
64
50
52
58
54
62
64
56
54

32
54
58
50

80
70
76
80
26
40
34
72
74
34

28
20

24
49
26
40
32
30

24

101
40
32
23
32
28
102
31

23

30

PUTTING BOX

This application claims benefit of 60,137,818 filed May 28, 1999.

FIELD OF THE INVENTION

The present invention is directed to a training device for improved aim, alignment and speed of putting strokes, and more particularly to a putting box which can be used in doors for practising golf putting.

BACKGROUND OF THE INVENTION

Numerous types of putting trainers are known which utilize a simulated putting green and a golf cup or target which can be used on a suitable surface, either indoors or outdoors. Difficult shots can be simulated by using inclined surfaces and/or by providing targets which are at a greater distance and/or smaller in size. Two such putting devices are described in U.S. Pat. No. 5,645,492 entitled Selectable Target Putting Trainer by Kevin Anderson issued Jul. 8, 1997 and also U.S. Pat. No. 5,205,559 entitled Putting Practise Target by Raymond P. Plopper issued Apr. 27, 1993.

The Plopper device is preferably used in conjunction with a golf putting cup and/or hole and therefore is more suitably used outdoors. The Anderson device has a plurality of targets of different size which can be selected, however, each target of different size will only house one ball at a time.

When putting indoors, golfers normally use a number of balls at a given time in order to reduce the amount of time necessary to retrieve one ball at a time. Golfers will use various targets which they will putt towards on either a carpeted indoor surface or some other simulated golfing surface in order improve their putting game.

The devices that are used and sold today, are generally very large and cumbersome to set up, take up a lot of space, are restricted in the number of balls which they will store at any given time and require a great deal of effort for cleaning up the area after the putting is done.

Therefore, it is desirable to have a putting practice target which will house a number of balls at a given time, will be easy to set up and remove once the putting has been completed, is small in size and easily and quickly set up and can be used on indoor carpeted surfaces.

SUMMARY OF THE INVENTION

The present invention A Putting Box comprises (a) a frame defining a putting target and a ball storage area for housing numerous balls therein, said frame having a bottom plane for placement onto flat surfaces;

(b) a ball aperture defined within a side of said frame adapted to allow golf balls to pass there through, said ball aperture providing an entry way for balls to rollably enter into said ball storage area of said frame when said frame is placed onto a flat surface; and (c) a means for diverting and maintaining said balls away from said entry way.

Preferably said diverting means includes a ball diverter for diverting balls away from said entry way and also for diverting and maintaining balls in said ball storage area.

Preferably said ball diverter includes a rolling surface lying substantially parallel and along said bottom plane, and adapted to rollably receive balls rolling through said entry way and rollably diverting and maintaining balls away from said entry way.

Preferably said rolling surface includes a convex surface which directs balls away from said entry way.

Preferably said rolling surface includes a sloped periphery, said periphery including an on ramp disposed across the mouth of said entry way, such that rolling balls must roll up said on ramp to enter said ball storage area.

Preferably said rolling surface includes and an off ramp adapted to rollably direct and maintain balls roll away from said entry way, wherein said balls roll down said off ramp and into said ball storage area.

Preferably said ball diverter includes a thin sheet metal rolling surface lying substantially parallel and along said bottom plane, and adapted to rollably receive balls rolling through said entry way and rollably diverting and maintaining balls away from said entry way.

Preferably said on ramp and off ramp is less than 0.250 inches in vertical height relative said bottom plane.

Preferably said on ramp and off ramp is preferably less than 0.0625 inches in vertical height relative to said bottom plane.

Preferably said on ramp is adapted to receive a rolling ball onto said rolling surface with a ball speed of less than 0.5 miles per hour.

Preferably said frame further includes a top for covering over the frame, wherein objects may be placed onto and supported by said top.

Preferably wherein said ball diverter occupies only part of the bottom plane, such that balls in the ball storage come to rest on the flat surface on which the frame is placed.

Preferably said ball diverter occupies the entire bottom plane, such that balls in the ball storage come to rest on the rolling surface.

BRIEF DESCRIPTION OF THE DRAWINGS

The invention will now be described by way of example only, with references to the following drawings in which:

FIG. 1 is a side elevational view of the Putting Box shown in FIG. 3;

FIG. 2 is a side elevational view of the Putting Box shown in FIG. 3;

FIG. 3 is a top plan view of the Putting Box;

FIG. 4 is a front side elevational view of the Putting Box shown in FIG. 3;

FIG. 5 is a bottom plan view of the Putting Box shown in FIGS. 1 through 4;

DETAILED DESCRIPTION OF THE PREFERRED EMBODIMENT

Figure 15:
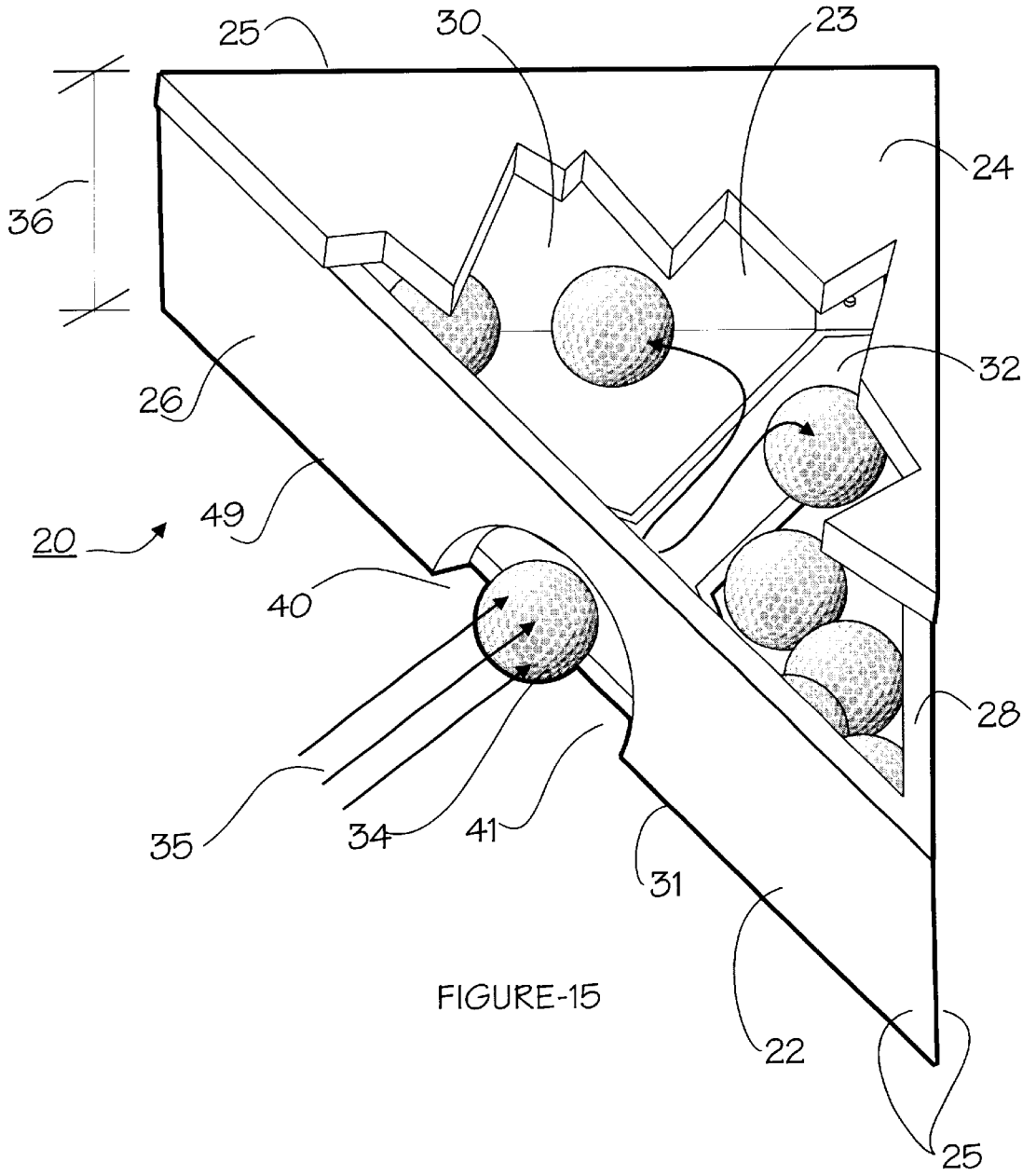
FIG. 15 is a partial cut away perspective view of the Putting Box showing portions of the ball storage area, the ball diverter as well as the frame.

Referring to all the Figures, but particularly FIG. 15 the present invention a Putting Box shown generally as 20 includes claim 22 having sides 25, front side 26, entry way 41 and ball diverter 32.

Figure 17:
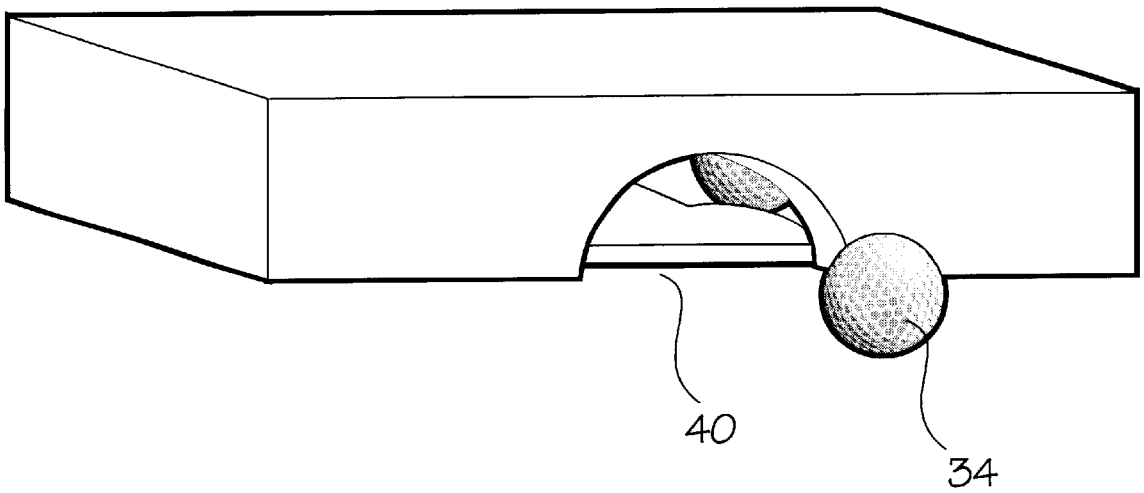
FIG. 17 is an alternate embodiment and a front perspective view of a Putting Box.
Figure 18:
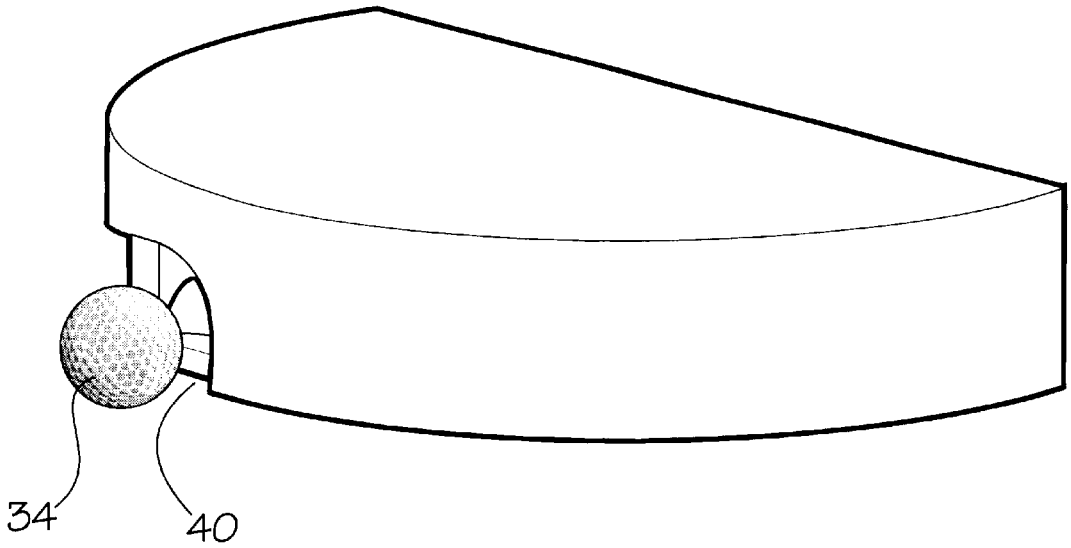
FIG. 18 is another embodiment and shown in a front perspective view of an alternate form of the Putting Box.

As shown in FIG. 15 which is a partial cut away perspective view of the Putting Box which has a frame 22 having a bottom periphery 31 which is normally placed in a room upon a carpet, not shown in any of the diagrams. Frame 22 is not limited to the shape shown in FIG. 15 and as shown in FIGS. 17 and 18 can also be any other practical shape. Frame 22 has sides 25 which are more or less upwardly extending sides and as shown in FIG. 15 there are three sides in total forming a triangular shape frame 22. One of sides 25 is a front side 26 which has defined therein a ball aperture 40 roughly centrally located along front side 26 which is sized to form an entry way 41 for golf balls 34 to enter there through.

Still referring to FIG. 15, the arrows show ball trajectory 35 schematically showing a golf ball 34 passing through entry way 41 and into the interior of frame 22 where balls reside in ball storage area 23. Golf ball 34 encounters ball diverter 32 which diverts golf ball 34 into various areas within ball storage area 23. Sides 25 include first rear side 28, second rear side 30, and front side 26. It would be apparent to a person skilled in the art that putting box 20 can comprise any number of sides which are practical. Frame 22 has a frame height 36 which preferably is slightly higher than the diameter of a golf ball 34. In order to ensure that golf balls 34 can roll through ball aperture 40 and entry 41 without being restricted.

Optionally Putting Box 20 has top 24 which covers the top of frame 22 in order to make putting box 20 more aesthetically pleasing.

Referring now to FIG. 15 as well as FIGS. 6 through 10 which show the details of ball diverter 32. FIG. 15 shows how ball diverter is mounted substantially along a bottom plan 49 of frame 22, such that when a golf ball 34 travelling along ball trajectory 35 enters through ball aperture 40 and entry way 41, the golf ball will roll up on ramp 56 and across entry edge 62 onto rolling surface 66 of ball diverter 32.

Ball diverter 32 includes a sloped periphery 54 on ramp 56, entry edge 62, rolling surface 66, front flanges 50, rear flanges 52, off ramps 58 and exit edges 64. Both the front flanges 50 and rear flanges 52 are substantially perpendicular to rolling surface 66 and parallel to sides 25 of frame 22. Front flanges 50 are used to securely fasten ball diverter 32 to the inside front side 26. Rear flanges 52 are used to securely fasten ball diverter 32 to the inside of first rear side 28 and second rear side 30 using fastener 60.

Rolling surface 66 is substantially flat, however, can be slightly convex, such that a ball 34 rolling upon rolling surface 66, will have a tenancy to either roll off a side of ball diverter 32. Sloped peripheries 54 and on ramp 56 elevate rolling surface 66 slightly above the carpet rolling surface in order that a ball will require a very small minimum velocity in order to climb up on ramp and get onto rolling surface 66.

Putting Boxes having various ball aperture sizes 40 can be constructed, wherein the larger ball aperture 40 the easier it is to putt a ball through entry way 41 whereas the smaller ball aperture 40, the more difficult it becomes to putt a golf ball 34 through entry way 41.

In use, the bottom periphery 31 of Putting Box 20 is placed onto a carpet in a room in which one wishes to practice putting. Frame 22 defines a target and specifically a golf ball 34 is aimed at the ball aperture 40.

Figure 16:
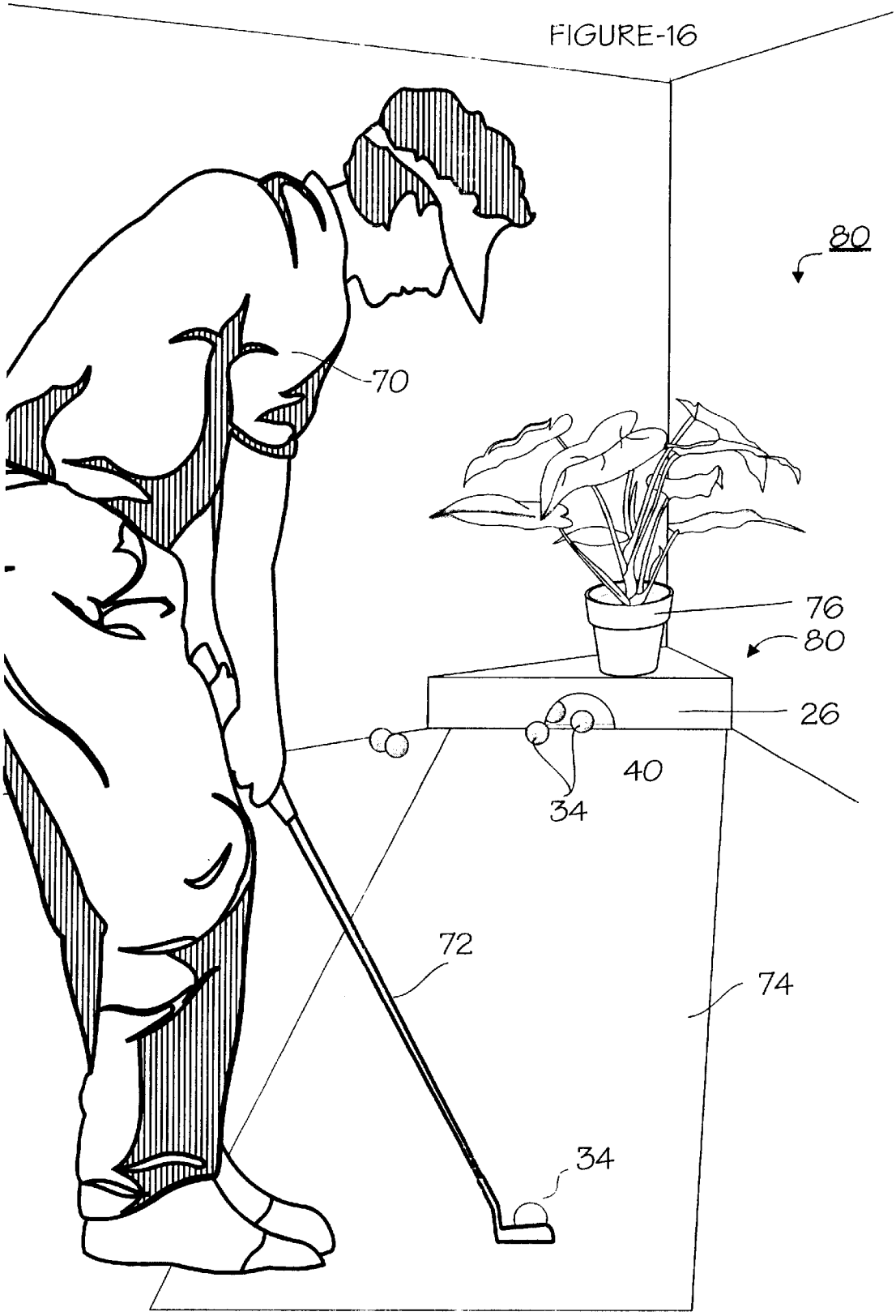
FIG. 16 is a perspective view of the Putting Box shown in situ placed in the corner of a room with a flower pot placed on top of it and schematically showing a person with a putter practising putting towards the entry way of the Putting Box.

Referring now to FIG. 16 which shows schematically how the Putting Box 20 can be used by a person 70 having a putter 72 wishing to put a golf ball 34 into aperture 40. In this case Putting Box 20 is shown schematically positioned in a corner 78 of a room 80 having a carpeted floor 74. The person 70 practising would normally have a number of balls that he would place on carpet floor 74 for putting towards Putting Box 20 at some distance away from the putting box 20. For example if one wants to practise a six foot putt, one would stand approximately six feet away from the front side 26 of putting box 20 and so forth.

Golf balls 34 having ball trajectory 35 will pass through ball aperture 40 in entry way 41. If golf ball 34 has a certain minimum predetermined velocity it will climb onto ramp 56 and cross entry edge 62 and roll onto rolling surface 66. Preferably rolling surface 66 is slightly convex thereby diverting golf balls 34 either to the left or to the right and towards off ramps 58 of ball diverter 32. It will be apparent to a person skilled in the art that even if rolling surface 66 is substantially flat, the trajectory of a ball is almost always skewed either to the left or the right and therefore, a golf ball 34 rolling on rolling surface 66 will have a naturally tendency to move off to the left or right side of ball diverter 32. Once a ball has rolled onto rolling surface 66, it will then roll off ball diverter 32 crossing exit edges 64 and rolling down off ramps 58 either to the left or to the right side of Putting Box 20 into ball storage area 23. Off ramps 58 and the sloped periphery 54 ensure that balls that have rolled off ball diverter 32 are not likely to roll back onto ball diverter 32 thereby ensuring that golf balls 34 stay in either the left or right hand side of Putting Box 20 in the ball storage area 23. The number of balls that ball storage area 23 may house can vary, depending upon the size of Putting Box 20, however, 6 to 12 balls is the preferred size of the storage area.

Putting Box 20 has no bottom other than what is provided by ball diverter 32. Therefore, balls rolling off rolling surface 62 roll onto carpeted floor 74 which is within the frame 22 of Putting Box 20. Therefore, by lifting Putting Box 20 off carpeted floor 74, the golf balls 34 in ball storage area 23 are immediately uncovered and are available for the person 70 practising putting to move these balls back to the desired start locations.

Figures 6, 7, 8, 9, 10:
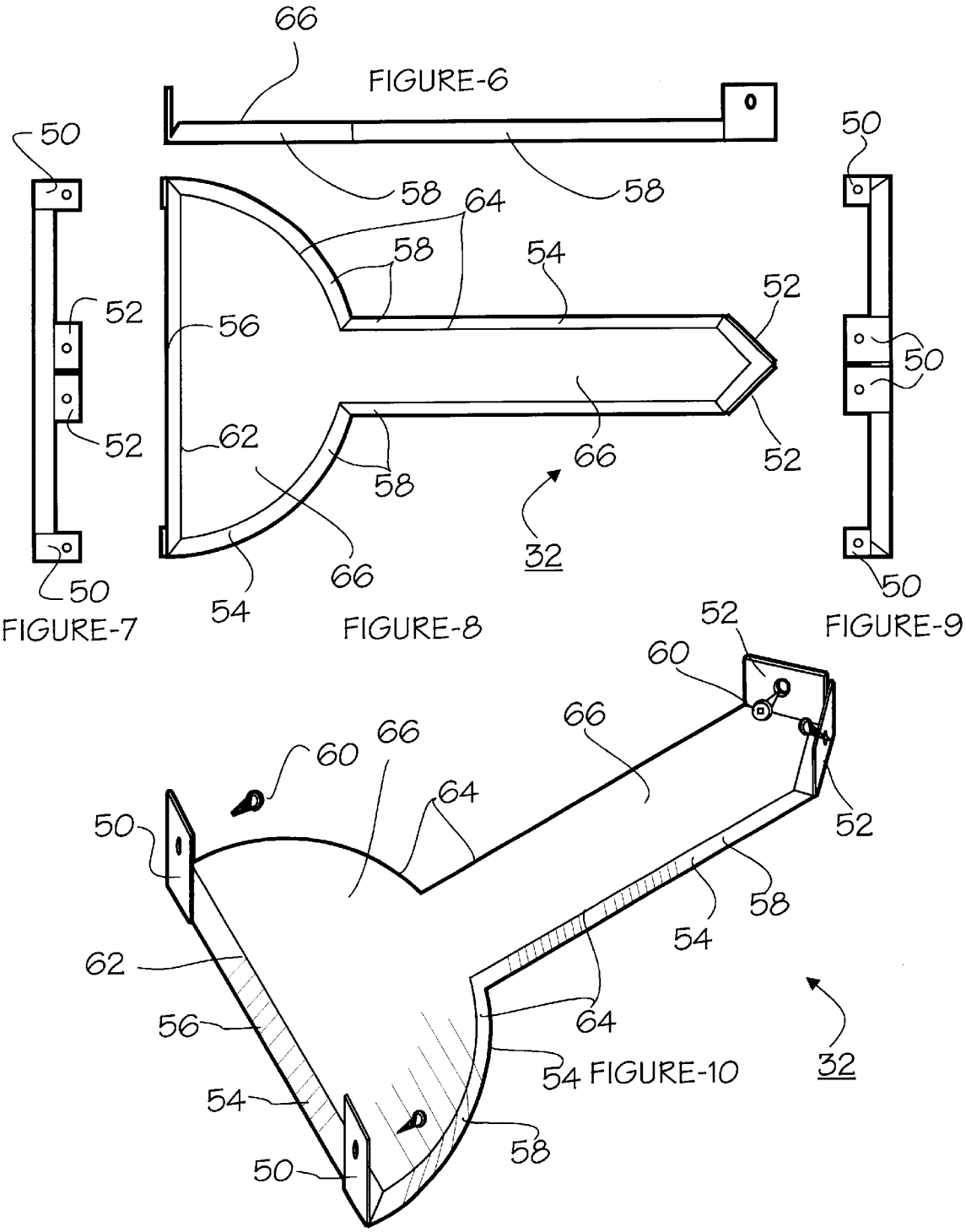
FIG. 6 is a side elevational view of the ball diverter shown in FIG. 8.
FIG. 7 is a end side elevational view of the ball diverter shown in FIG. 8.
FIG. 8 is a top plan view of the ball diverter.
FIG. 9 is a end side elevational view of the ball diverter shown in FIG. 8.
FIG. 10 is a top perspective view of the ball diverter shown in FIGS. 6 through 9.
Figure 11:
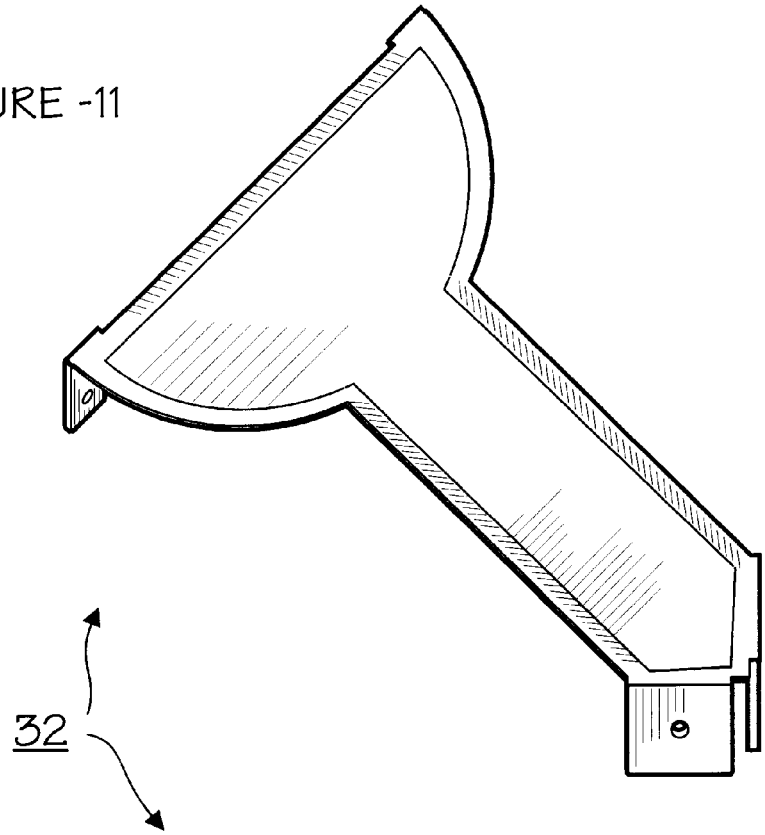
FIG. 11 is a bottom perspective view of the ball diverter shown in FIGS. 6 through 8.
Figure 12:
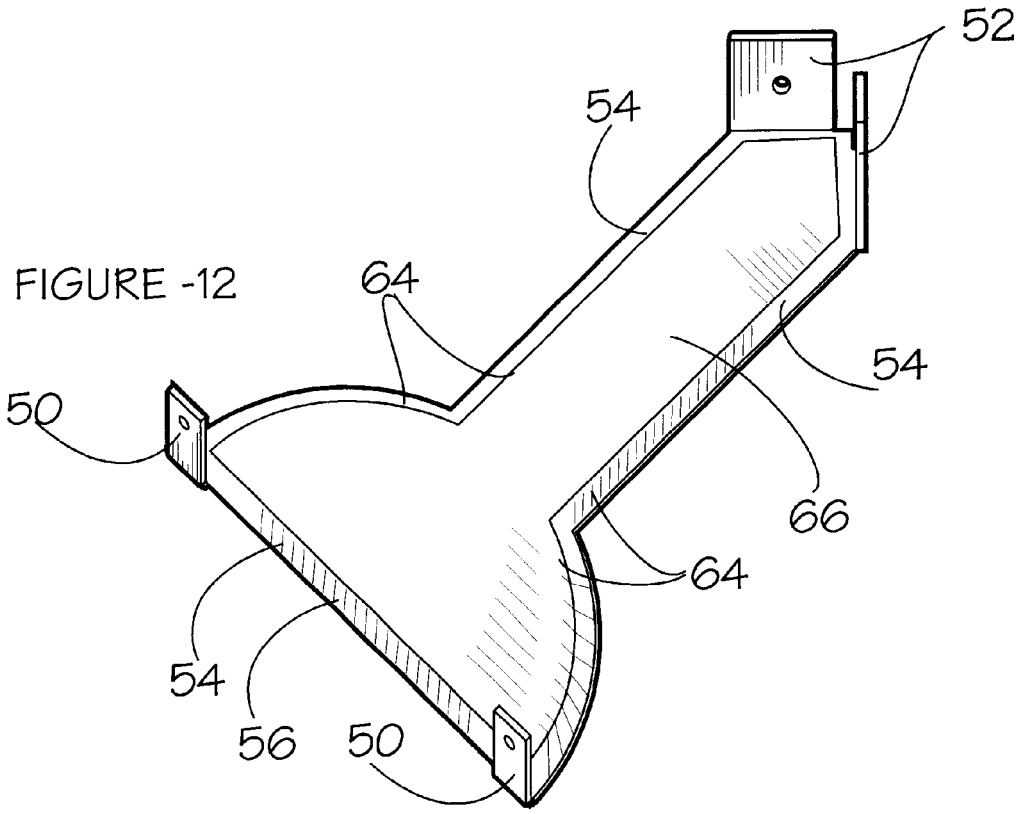
FIG. 12 is a top perspective view of the ball diverter shown in FIGS. 6 through 9.
Figures 13, 14:
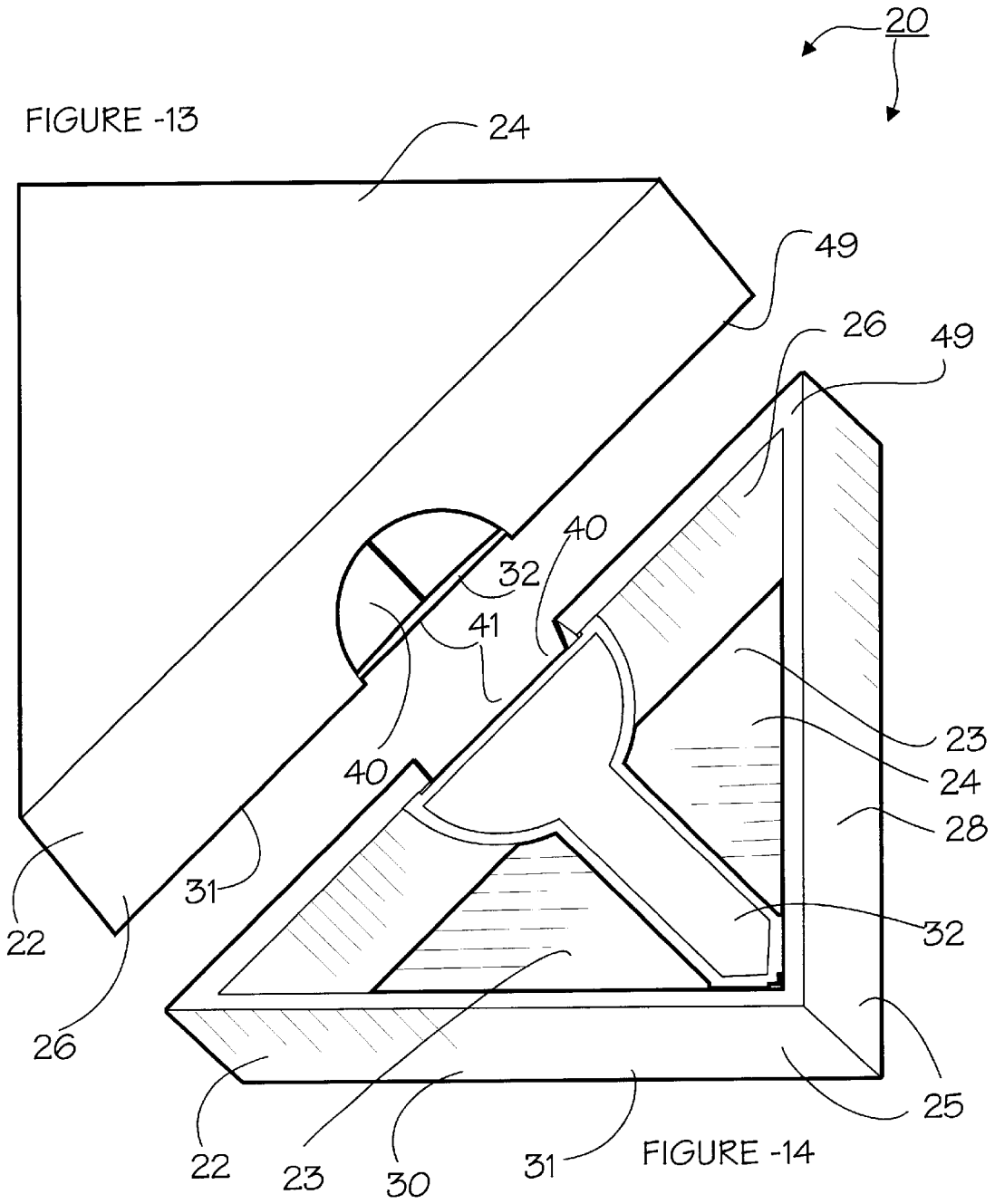
FIG. 13 is a top perspective view of the Putting Box particularly showing the top and front side.
FIG. 14 is a bottom perspective of the Putting Box showing the ball diverter in situ.

Please note that the shape of ball diverter 32 as shown in top plan view of FIG. 8 can be changed without changing the nature of how the ball diverter works and can be any number of shapes other than what is shown in the figures attached. Ball diverter 32 may in fact be as simple as a wire stretched across ball aperture 40 along bottom plane 49 and a second wire running from roughly the centre of ball aperture 40 to the back corner of Putting Box 20 along bottom plane 49. Thereby balls crossing these wires will be diverted into one side or the other of the storage box.

Another example would be to make the ball diverter 32 the size of the entire bottom of frame 22, therefore all the golf balls 34 are inside ball storage area 23 and when Putting Box 20 is lifted off carpet floor 74 the balls are lifted with the Putting Box 20 and the balls would have to be emptied from putting box 20 by either having a removable top 24 and/or tilting Putting Box 20 such that the balls exit out of ball aperture 40.

Figures 19, 20, 21, 22, 23, 24, 25, 26:
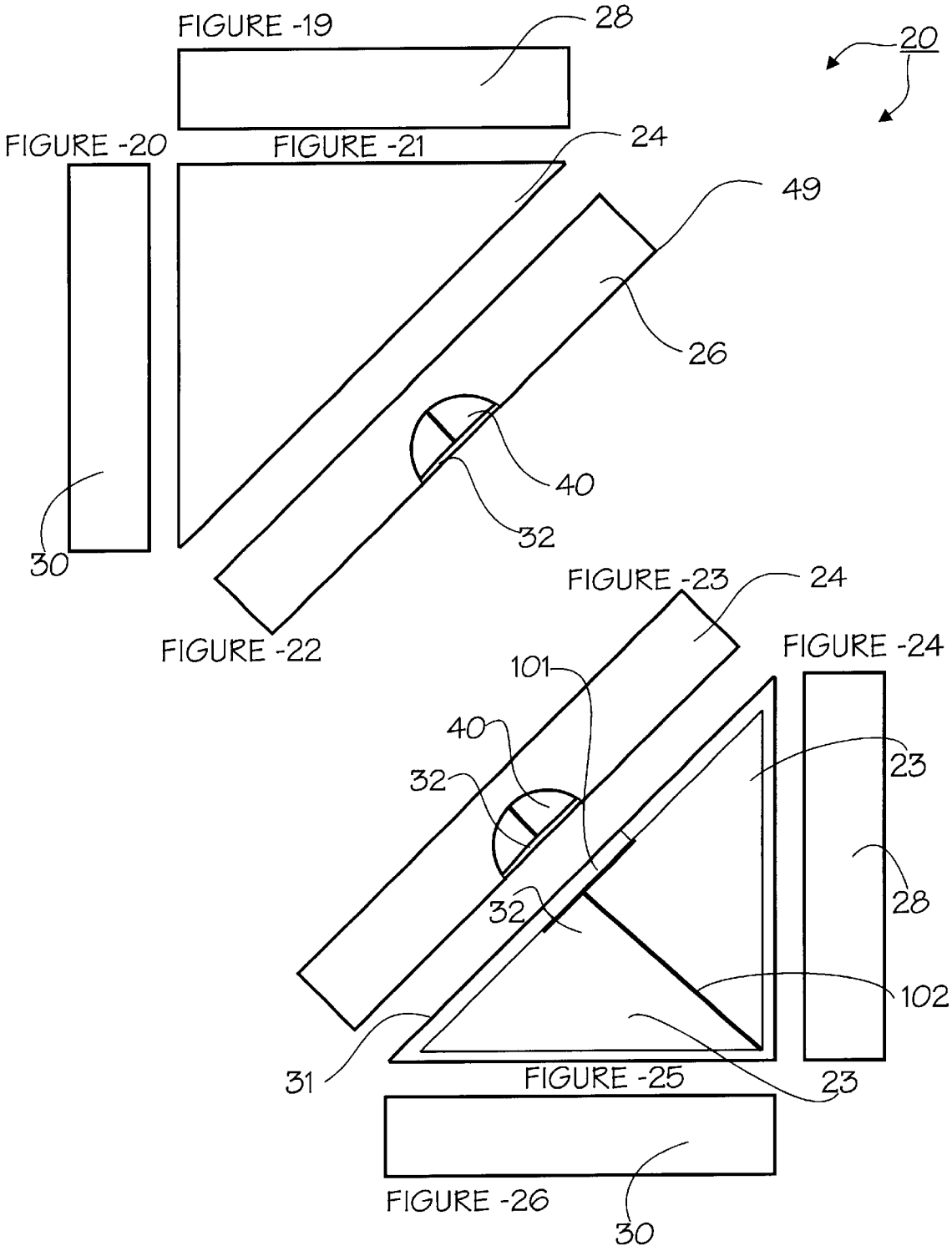
FIG. 19 is a side elevational view of the Putting Box.
FIG. 20 is a side elevational view of the Putting Box.
FIG. 21 is a top plan view of the Putting Box.
FIG. 22 is a front side elevational view of the Putting Box.
FIG. 23 is a front side elevational view of the Putting Box.
FIG. 24 is a side elevational view of the Putting Box.
FIG. 25 is a bottom plan view of the Putting Box.
FIG. 26 is a side elevational view of the Putting Box.

In a further embodiment shown in FIGS. 19 through 26 the ball diverter can be made of a first thin wire 101. Further one can add an additional second wire 102 to provide a wire formed T shaped ball diverter as shown in FIG. 25. It will apparent to those skilled in the art that a similar function can be achieved with a number of differently shaped diverters.

It should be apparent to persons skilled in the arts that various modifications and adaptation of this structure described above are possible without departure from the spirit of the invention the scope of which defined in the appended claim.

I claim:

1. A Putting Box for placement onto a floor surface, said putting box comprising;

(a) a frame defining a putting target and a ball storage area for housing balls therein, said frame having a bottom plane for placement onto floor surfaces;

(b) a ball aperture defined within a side of said frame adapted to allow golf balls to pass there through, said ball aperture providing an entry way for balls to rollably enter into said ball storage area of said frame when said frame is placed onto a floor surface; and (c) a means for diverting and maintaining said balls away from said entry way and maintaining balls in said ball storage area, wherein balls come to rest on a floor surface in said ball storage area of said frame, such that vertically lifting said frame off a floor surface leaves said balls stationary and grouped together on a floor surface.

2. The Putting Box claimed in claim 1, wherein said frame includes a top enclosing said frame, such that balls entering through said ball aperture are stored in said ball storage area such that stored balls are not visible when said putting box is resting on a floor surface, such that said putting box provides an unseen storage area for golf balls.

3. The Putting Box claimed in claim 2, wherein said ball diverter includes a rolling surface lying substantially parallel and along said bottom plane, and adapted to rollably receive balls rolling through said entry way and rollably diverting and maintaining balls away from said entry way.

4. The Putting Box claimed in claim 3, wherein said rolling surface includes a convex surface which directs balls away from said entry way.

5. The Putting Box claimed in claim 4, wherein said rolling surface includes a sloped periphery, said periphery including an on ramp disposed across said entry way, such that rolling balls must roll up said on ramp to enter said ball storage area.

6. The Putting Box claimed in claim 5, wherein said rolling surface includes and an off ramp adapted to rollably direct and maintain balls away from said entry way, wherein said balls roll down said off ramp and into said ball storage area.

7. The Putting Box claimed in claim 6, wherein said ball diverter includes a thin sheet metal rolling surface lying substantially parallel and along said bottom plane, and adapted to rollably receive balls rolling through said entry way and rollably diverting and maintaining balls away from said entry way.

8. The Putting Box claimed in claim 7, wherein said on ramp and off ramp is less than 0.250 inches in vertical height relative said bottom plane.

9. The Putting Box claimed in claim 8, wherein said on ramp and off ramp is preferably less than 0.0625 inches in vertical height relative to said bottom plane.

10. The Putting Box claimed in claim 5, wherein said on ramp is adapted to receive a rolling ball onto said rolling surface with a ball speed of less than 0.5 miles per hour.

11. The Putting Box claimed in claim 2, wherein said top is a planar surface adapted to support loads such that objects may be placed onto and supported by said top thereby said putting box providing an hidden storage area for golf balls and also acting as a base or stand capable of supporting objects.

12. The Putting Box claimed in claim 2, wherein said ball diverter comprises a thin wire extending across said entry way thereby permitting entry of balls having a certain preselected minimum speed.

13. The Putting Box claimed in claim 12, wherein said ball diverter comprises a thin wire extending across said entry way thereby permitting entry of balls travelling at least 0.5 miles per hour.

14. The putting box claimed in claim 12, wherein said ball diverter comprises a first thin wire extending across said entry way and a second thin wire disposed perpendicular to the first and attached centrally to said first wire and extending to a rear side of the putting box substantially along the bottom plane, such that said first wire receives balls rollably through said entry way and said second wire diverting balls to said storage area.

15. The putting box claimed in claim 14, wherein said first and second thin wires are less than 0.25 inches in diameter.

16. The putting box claimed in claim 15, wherein said first and second thin wires are less than 0.0625 inches in diameter.

17. The putting box claimed in claim 1, wherein said frame includes a top enclosing said frame, such that balls entering through said ball aperture disappear from sight thereby simulating the disappearance of a golf ball when putting into a golf putting cup.

* * * * *